US005524469A

United States Patent [19]

Sherwood

[11] Patent Number: 5,524,469

[45] Date of Patent: Jun. 11, 1996

[54] ROLLING MILL STAND

[76] Inventor: William L. Sherwood, 7249 Cypress Street, Vancouver, B.C., Canada, V6P5M2

[21] Appl. No.: 151,991

[22] Filed: Nov. 8, 1993

[51] Int. Cl.[6] ..... B21B 31/02

[52] U.S. Cl. ..... 72/241.2; 72/248; 72/249

[58] Field of Search ..... 72/234, 235, 237, 72/238, 242.2, 243.6, 247, 248, 249, 241.2

[56] References Cited

U.S. PATENT DOCUMENTS

| | | | |
|---|---|---|---|
| 3,628,366 | 12/1971 | Leitner | 72/249 |
| 3,718,026 | 2/1973 | Gawlikowicz et al. | 72/249 |
| 4,319,475 | 3/1982 | Stikeleather | 72/237 |
| 4,325,245 | 4/1982 | Sherwood | 72/248 |
| 4,581,911 | 4/1986 | Shinomoto | 72/237 |
| 4,949,568 | 8/1990 | Poloni | 72/239 |

FOREIGN PATENT DOCUMENTS

| | | | |
|---|---|---|---|
| 2340146 | 9/1977 | France | 72/243.6 |

*Primary Examiner*—Lowell A. Larson
*Assistant Examiner*—Thomas C. Schoeffler

[57] ABSTRACT

The invention focuses on improvements to cantilevered roughing, intermediate and finishing rolling mill stands, primarily for long products. A basic improvement to 2-high and cluster mill stands includes mounting of the rolling bearings upon a stationary cantilevered arbor directly under the roll ring, eliminating heavily-loaded main reaction bearings within the stand housing in limited radial space. Individual drive motor assemblies for each shaft, rigidly coupled and directly supported by the drive shafts, are also advocated, in preference to floor-mounted drives via pinion stands to spindles and couplings. This eliminates drive reaction forces acting against the stand assembly, allowing direct measurement and control of interstand tension/compression, for which appropriate hardware is outlined. A cluster mill assembly features work roll cartridge assemblies adapted for off-line set-up and ultra-fast roll and guide changes, which is particularly adapted to intermediate and finishing pass applications. The work rolls are neckless, with the cartridge frame and bearings serving only to maintain roll position, rather than carry rolling loads. Roll size and material can then be governed entirely by stock size and reduction requirements, rather than by load carrying capacity. Included are means for axial adjustment of roll position, and roll parting adjustment symmetrically about the pass line. Mountings having quickly-interchangeable horizontal, vertical or angular transverse orientation are additional features, as are applications to tandem mill trains incorporating direct, automatic cascade tension-free rolling.

14 Claims, 5 Drawing Sheets

ROLLING MILL STAND

The invention relates to metal rolling mills and, more particularly, to rolling mill stands unable for use in tandem rolling mill trains.

Heretofore, cluster rolling mills have been applied mainly to flat rolling. Cantilevered mill stands applied to rod, bar and shape rolling have been of the two-high type with gear-driven work rolls rigidly fixed upon cantilevered drive shaft arbors, incorporating main load bearings within the stand housings to support the drive shafts. In order to change rolls on such rolling mill stands, each roll must be removed and replaced by re-fixing individually. The minimum roll diameter which can be applied is also limited by minimum arbor size and by radial space requirements of the main bearing carrying the cantilevered rolling load.

Each rolling mill stand and its drive unit are separately mounted, each on a fixed base, and are connected together by rotating drive shafts and couplings. Direct measurement of interstand tension/compression is very difficult in tandem rolling, because of reaction forces acting upon the mill stand via the drive shafts.

The objects of this invention include the following:

a) to eliminate rolling-load carrying members and bearings from a work roll cartridge assembly achieving markedly improved cartridge lightness, compactness and capability for quick roll changes, a matter of seconds rather than minutes;

b) to make possible less work roll size, weight, complexity and cost by eliminating load-carrying roll necks;

c) to provide for cartridge pre-setting off-line of roll guide and axial roll-pass position settings, relative to pass-line, to remain fixed, as set, during operation, including during roll parting adjustments, at the same time allowing easy on-line adjustments of these parameters, if needed;

d) to allow increased freedom to select roll size according to optimum passes required, particularly as to smaller roll diameters on small stock, towards increased reduction, decreased lateral spread, closer tolerances and reduced energy consumption;

e) to provide for application of multiple small drives to power each roll stand, rather than single large drive to achieve economy, flexibility and space saving, such as realizable by hydraulic motor drives mounted directly on the stand back-up roll input shafts and supported by the shafts without independent supports;

f) to make available a range of reduction (gear) ratios integral with the stand design without the application and cost of gears, for example, large diameter work rolls and smaller diameter back-up rolls in roughing passes on large stock, achieving increased torque at lower speed;

g) to facilitate the direct measurement of interstand tension/compression in tandem mill stand arrangements and thereby the direct control of interstand speed according to the desired interstand values, e.g. tension-free rolling; and h) to provide a mill stand easily adaptable to mounting horizontally, vertically or at any other angle desired.

A basic embodiment provides a rolling mill stand having a housing with rolls cantilevered out from the front wall of the housing with at least one top roll assembly and one bottom roll assembly, comprising a cantilevered roll shaft sleeve arbor projecting out from the front wall incorporating an open-ended axial passage extending the arbor full length and opening through the housing drive-end back wall; a roll ring encircling the exterior projecting circumference of the arbor with an annular bearing interfacing between the outer circumferential surface of the arbor and inner circumference of the roll ring, radially fixing and supporting but allowing low-friction rotation of the roll ring about the arbor; a roll drive-shaft co-axial within the sleeve arbor and spanning the length of the axial passage through the arbor; a roll drive connected to the drive end of the drive-shaft adapted to provide rolling torque and rotation as required for rolling; a radial coupling connecting between the operating end of end drive-shaft and the roll ring adapted for transmitting rolling torque and rotation directly from the roll drive-shaft to the roll ring. It is preferred to include roll parting adjustment adapted for adjusting the distance of separation between the top and bottom arbors and thereby between the top roll and bottom roll rings.

A specific embodiment of the invention is a cantilevered cluster rolling mill stand assembly having at least two pairs of back-up rolls cantilevered out from the front wall of a stand housing, which includes drive shaft means of at least one said pair of back-up rolls, that is, driving one top and one bottom back-up roll, thereby effecting rotation by frictional surface contact of a top work roll and bottom work roll pair, characterized by the combination with a removable work roll cartridge sub-assembly integral with the work roll pair, the cartridge comprising a rigid support frame carrying work roll-end chocks with axial-positioning bearings confining each end of each work roll, adapted for maintaining the top work roll in substantially fixed axial relation with the bottom work roll during rolling. The preferred embodiment incorporates axial adjustment of the axial-positioning bearings, adapted for changing the fixed axial position of the top work roll in relation to the axial position of the bottom work roll.

The cluster rolling mill preferably comprises driven back-up roll assemblies according to the basic embodiment described in the preceding paragraph.

The work roll cartridge sub-assembly preferably includes integral roll balancing means pressing apart and separating the work roll chocks to maintain the work rolls in contact with the back-up rolls when the mill stand is empty, preferably including rolling guides mounted upon the rigid support frame and symmetrical work roll separator means adapted for supporting and separating the top and bottom work roll chocks to always move substantially equal distances above and below a pass center line, thereby maintaining the guides aligned with the pass across various settings of the parting between the top and bottom work roll. Also included is a quick-latching feature between housing and work roll cartridge comprising cartridge assembly stop means mounted on the housing; side lug means mounted on a cartridge assembly side-bracket, aligned to abut the cartridge stop upon work roll insertion between the back-up rolls; and latch retainer means adapted to latch and hold the lug against the stop during operation, thereby maintaining the work roll cartridge sub-assembly axially fixed in position, and to retract and allow cartridge removal and replacement during non-operating periods.

Preferred embodiments of the invention include a drive arrangement incorporating rigid coupling between motor and drive shaft thereby supporting the motor assembly; a floating torque-reaction-frame having stop surfaces to intercept a pair of torque-couple-lugs on each drive, the opposing forces on each lug cancelling each other and thus eliminating side loading of the drive shafts, and the approximately equal and opposite rotation torques of top and bottom roll shafts also substantially cancelling any resultant rotational movement of the frame. At the same time, the frame and stop-surfaces are located to allow movement of the lugs during adjustment of the roll parting symmetrically about the pass line. An optional feature comprises circular screw-down sleeves encircling with axes parallel but offset equally and eccentrically each roll shaft sleeve arbor, adapted for sliding rotation within annular openings in the housing box front and back walls, with preferred means of adjustment; being worm gears concentrically encircling each top and bottom sleeve arbor actuated by worms of opposite hand mounted on a common worm shaft, thereby being adapted to adjust the parting of top and bottom rolls symmetrically above and below the pass line.

According to the invention, it is preferred that the drive means are entirely mounted as integral components of the rolling mill stand assembly with drive-torque reaction forces confined within the assembly rather than against any stand mounting, supporting or adjacent structures. Then, when a stand is mounted for rolling common interstand stock, in tandem with at least a preceding mill stand, drive-torque reaction forces are confined within the assembly rather than against any stand mounting, supporting or adjacent structures. Stand mounting may then comprise linear bearing support means for the assembly adapted to allow substantially free longitudinal movement back and forth in the rolling direction, but substantially preventing transverse planar, yawing or rotational movement; a load-bar connecting between each stand and the immediately preceding tandem rolling mill stand, thereby adapted to directly measure longitudinal tension/compression force within interstand stock; and speed of regulation means adapted for adjusting the roll rotational speed said stand to substantially maintain the tension/compression force between stands close to a preselected value during the course of rolling. The load-bar may incorporate a load-measuring cell to which the interstand tension or compression is applied via intermediate springs and in which the maximum travel of the springs is limited by mechanical stops, thereby limiting the maximum pressure applied to the load-measuring cell to the value of the spring tension or compression force at contact with said stops, the balance of the interstand forces being borne by rigid members integral with the load-bar.

Various other objects, features and advantages of the apparatus of this invention will become apparent from the following detailed description and claims and by referring to the accompanying drawings, in which:

Figure 1:
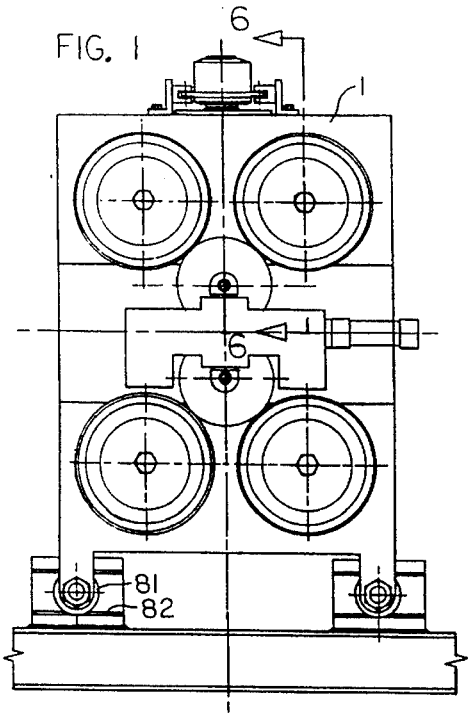
FIG. 1 is an operating end elevation view of a rolling mill stand according to the invention.
Figure 2:
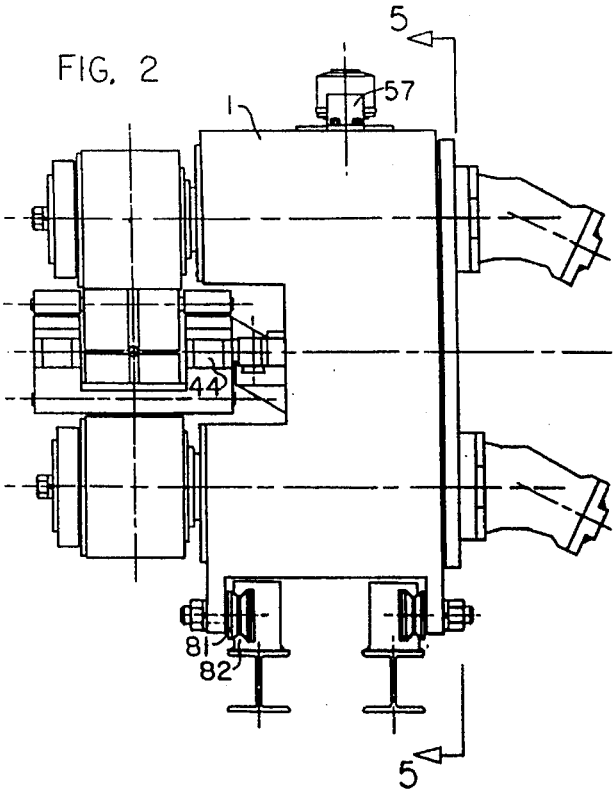
FIG. 2 is a side elevation of the rolling mill stand.
Figure 3:
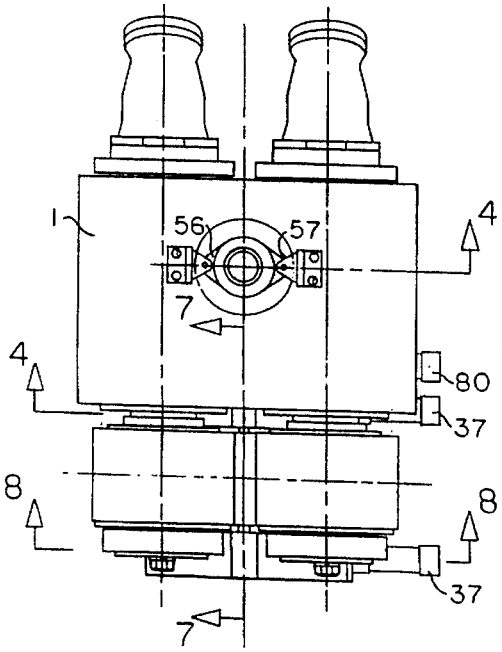
FIG. 3 is a top view of the rolling mill stand.
Figure 4:
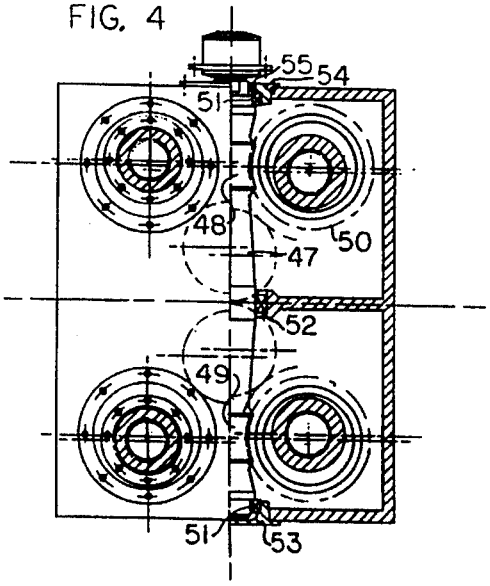
FIG. 4 is a section view along two different parallel vertical planes on either side of center line indicated 4—4 of FIG. 3.

The rolling mill stand illustrated by FIGS. 1–8 is formed by the cooperation of two integral assemblies: (1) a semi-permanent back-up roll and drive assembly including driven back-up rolls and stand drive, incorporating the rolling-load carrying bearings and other elements; and (2) a replaceable roll cartridge assembly incorporating work roll axial positioning, balancing, rest bars and guides, but not the rolling-load carrying elements. Rapid exchange of these work roll cartridges is provided with this combination.

The back-up roll assembly and drive arrangement comprises a housing box 1 incorporating four circular apertures line-bored through the front wall 2 on the working side and back wall 3 on the side of the housing, each aperture encircling a back-up roll shaft assembly. The screwdown sleeve 4 is journalled for sliding rotation against the endplate bearing aperture surfaces 5, 6, and is retained axially in position by abutment of annular step-shoulder 7 against annular counter-bore shoulder 8 on one side and bolted annular sleeve retainer ring 9 on the other side. Operating end plate 10 and drive end plate 11 of screwdown sleeve 4, in turn, are eccentrically line-bored to retain roll shaft sleeve arbor 12, with center line 13 offset from sleeve center line 14 according to the desired range of roll parting adjustment. The mating surfaces 15, 16 between screwdown sleeve 4 and roll shaft sleeve arbor 12, may be either fixed, i.e. a single rigid assembly, or sliding, with substantially equivalent results during operation. The embodiment illustrated allows sliding contact, with axial retention by step-shoulders 17, 18 of arbor 12 riding between the shoulder of drive end reaction wall 3 and bolted arbor retainer ring 19.

Figure 5:
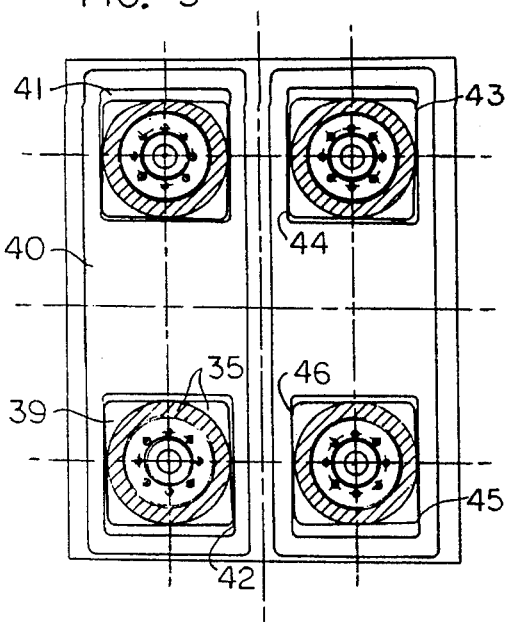
FIG. 5 is a section view along plane 5—5 of FIG. 2.
Figure 6:
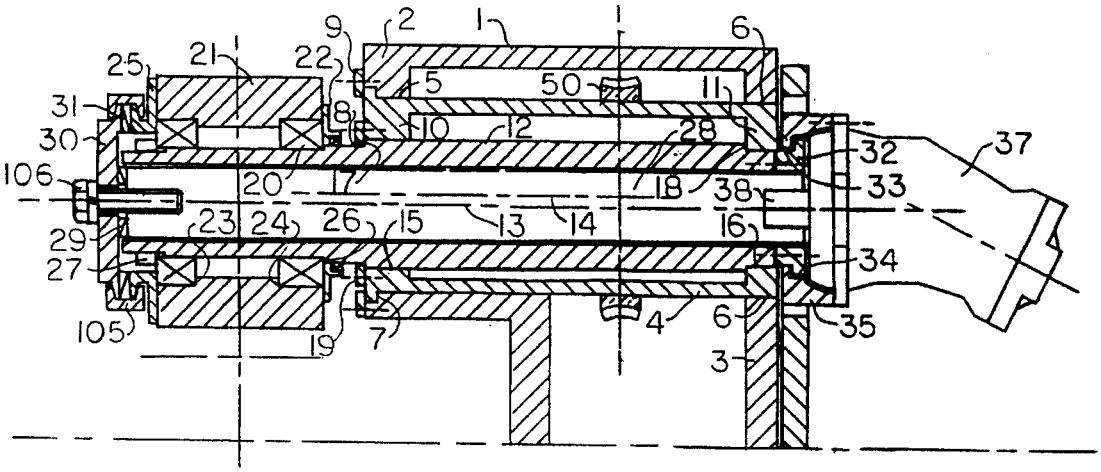
FIG. 6 is a partial section view along plane 6—6 of FIG. 1.
Figure 7:
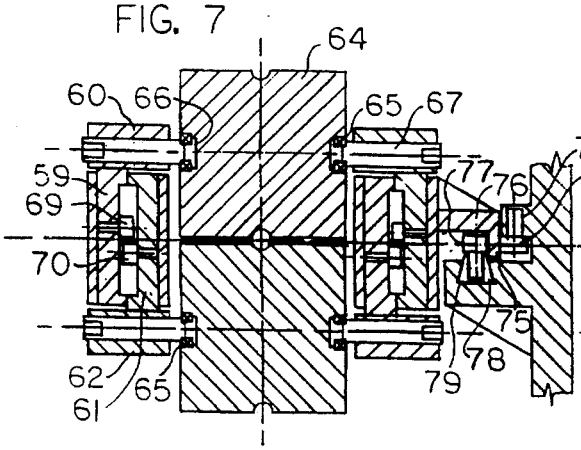
FIG. 7 is a section view of the cartridge assembly along plane 7—7 of FIG. 3.
Figure 8:
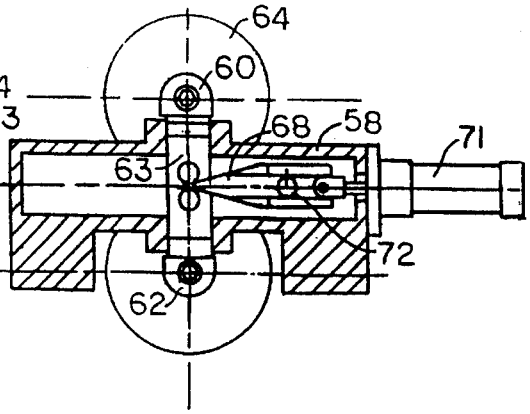
FIG. 8 is a section view of the cartridge assembly along plane 8—8 of FIG. 3.

The rolling load-carrying bearings 20 are mounted with the outer rings fixed inside back-up roll ring 21 by seal-support retainer ring 22, ring internal step-shoulders 23, 24, and retainer coupling plate 25 fixed to roll ring 21. The roll ring and bearing assembly pushes onto arbor 12, abutting against step-shoulder 26 and is held in place by lock nut 27. The output shaft of hydraulic motor 37 is splined into the end of drive shaft 28 extending through the length of roll shaft sleeve arbor 12. Inner end-spline coupling 29 at the working side transmits the rotation to drive torque cover plate 30 retained axially by bolt 32. Outer end-spline coupling 31, encircled and held together by split coupling-cover 105, transfers the torque to coupling plate 25 and thereby rotates roll ring 21. Essentially rigid fixation of motors 37 onto drive shaft 28 is accomplished, in the embodiment illustrated, by way of annular retention ring 32, bolted onto the drive end of roll shaft sleeve arbor 12, incorporating radial guide-surface annulus 33 and external axial-retainer annulus 34. The motor torque-couple plate 35 which is bolted to motor 37 includes an internal axial-retainer annulus 36 mating with surface 33, and abutting annulus 34, thus locking the externally splined male motor output shaft 38 into the matching female spline of the drive shaft 28. Referring particularly to FIG. 5, each couple-plate 35 is provided with four corner torque-arm lugs 39 spaced radially at 90 degrees to each other.

Corresponding pairs of rolls, one roll above and the other below the pass line, rotate in opposite directions with essentially equal and opposite torque values, but during adjustment of roll parting, the roll shaft assembly moves symmetrically in opposite directions on either side of the pass line, along the paths defined by the screwdown eccentrics. In order to consistently restrain rotation throughout the range of this movement, the lugs 39 are flamed within window openings 41 of a top-and-bottom-roll encompassing floating torque-reaction frame 40, and are restrained from rotation by abutment against the inner lug-stop surfaces 42 of openings 41 as motor rotation and torque is applied, thus transferring the rotation solely to the drive shaft 28 and hence to the roll rings 21. Although the window opening 41 need be just wide enough to allow insertion of the lugs, it should be deep enough to allow the full vertical travel of the eccentric screwdown assembly for adjustment of roll parting. In order to restrain rotation and maintain equivalent reaction torques through the range of this movement, any retaining, or movement limiting members keeping frame 40 in position should not interfere with its free self-centering movement under load, as acted upon by the two pairs of opposite-acting lugs, for example, at 43, 44 clockwise versus 45, 46 counterclockwise, on top and bottom rolls respectively. It will be noted that the lugs act as torque couples, in pairs essentially 180 degrees from each other across roll center line, one pair of the four on each roll acting in one rolling direction, and the alternate pair acting in the reverse rolling direction.

The adjustment of roll parting is accomplished by the eccentric rotational movement of all four back-up roll shaft assemblies simultaneously, by a single worm shaft 47 carrying a top roll worm 48 and bottom roll worm 49, of opposite hand, which engage worm gears 50. The shaft is supported in the housing by radial-thrust bearings 51 and radial center-guide bearing 52, which are mounted between removable retainer cover-plate 53 and drive shaft cover plate 54 with oil seal 55. The embodiment also illustrates a rigid shaft attachment of the screwdown drive motor, which is restrained from rotation by torque-arm lugs 56 acting as a torque-couple against pins carried by twin torque-brackets 57.

The work roll cartridge assembly comprises a rigid support frame 58 configured to carry the desired rest bar and guide arrangement (not shown). A top-roll slide 59 carrying the top roll-positioning chock 60 and bottom-roll slide 61 carrying bottom roll-positioning chock 62, is contained within guide-track 63 of frame 58, acting in pairs at each end of the work rolls 64 with movement perpendicular to the pass line. The work rolls 64 have axial retention bearing cartridges 65 with their outer races fitted into axial recess 66 at each roll end. Chock-mounted axial adjustment nuts 67 mate with and position the inner face of bearing cartridge 65. Symmetrical roll balancing is effected by means of double-wedge 68 acting between top slide track-roller 69 and bottom slide track-roller 70. The wedge 68 is operated by cylinder 71 and maintained on-center by guide track-roller 72. In this way, dynamic roll balancing and adjustable axial roll centering are accomplished.

In order to facilitate the quick-changing of work-roll cartridge assemblies, a track-roller stop 73 is mounted on housing bracket 74. When the cartridge assembly is inserted between the backup roll rings 21, axial side lug 75 mounted on cartridge side-bracket 76 abuts against roller stop 73. A track-roller latch 77 is mounted on slide 78 which is guided along track 79 parallel to the pass line, maintained in the retracted position for cartridge insertion and removal. Cylinder 80 is extended for operation locking lug 75 between rollers 73 and 77, to maintain the cartridge assembly axially latched during rolling.

Figure 9:
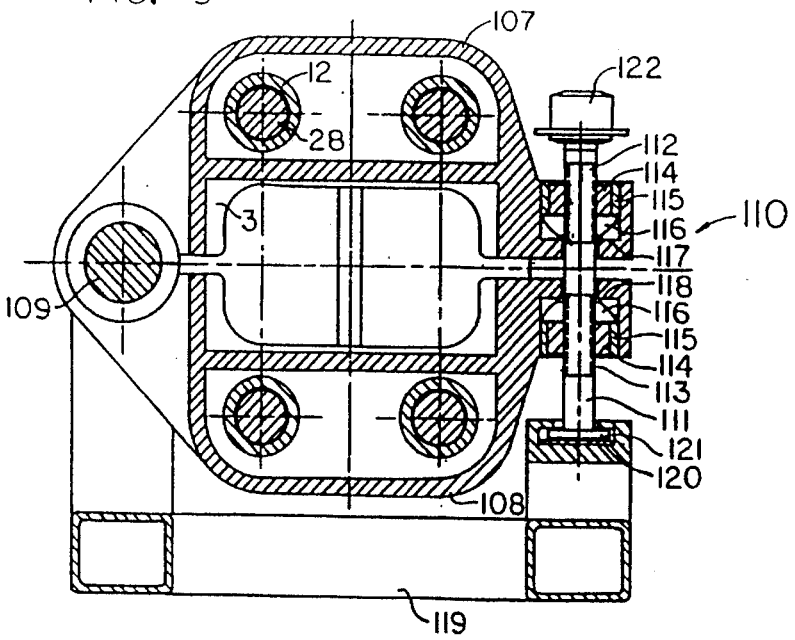
FIG. 9 is an operating end (front) sectional view of an alternative mill stand housing arrangement according to the invention.

Clamshell double housing boxes may be employed as alternatives to the single housing box 1, as another embodiment of the invention. These may comprise single-hinged boxes, or double-hinged boxes as in my U.S. Pat. No. 4,325,245, in which clam closure and thereby roll parting adjustment is also effected by worm-operated eccentric bushings. FIG. 9 illustrates such a clamshell with a direct screwdown, showing a longitudinal vertical section at the location of a screwdown post.

The assembly includes a top backup-roll housing box 107 and a bottom backup-roll housing box 108 supported around hinge pin 109 on one side, with roll parting adjustment by the screwdown assembly 110 on the other side. The four back-up rolls, again, are turned by motors acting through drive shaft 28. Sleeve arbor 12 may be rigidly fixed within line-bored openings of operating end and drive end 3 load walls. Alternatively, the portion of interior arbor 12 within boxes 107 and 108 may be omitted entirely, having only the cantilevered rolling end portion of the arbor mounted externally, directly on the operating end wall, also fastening annular retention ring 32, or its equivalent, directly to drive end reaction wall 3.

Screw shaft 111 incorporates a top-box thread 112 and a bottom-box thread 113 of opposite hand. Screwdown nuts 114, restrained from rotation by inserts 115, act against spherical thrust bearings 116 which apply direct screwdown pressure to top and bottom clamshell screwdown flanges 117, 118. Stand base 119 supports hinge pin 109 at one side and longitudinal bearing-slot 120 at the other side, confining end plate 121 of shaft 111 to allow horizontal movement only, thus maintaining a fixed pass center-line between boxes 107 and 108 during roll parting adjustment. Screwdown shaft 111 may be mechanically operated by hydraulic motor 122 or other suitable actuator. Two such screwdown assemblies 110 may also be applied together, such as for high stand rigidity requirements.

It will be seen that this arrangement simplifies the roll support arrangement within the housing box, and the housing is smaller. Roll adjustment is also linear, rather than a modified sinusoidal relation. Another advantage is a central through-opening, allowing easier egress of water and scale. Various other parts are not detailed, as their development is obvious from the prior single-unit housing description.

As well as individual operation, the stands FIGS. 1–9 are applicable in multi-stand tandem rolling mill arrangements. Stand housing boxes 1 can be mounted on fixed supports with appropriate bolts or other fastening. Alternatively, they may be carried such as on low-friction cam followers or track-rollers 81 mounted to run on fixed guide track 82, which are grooved or otherwise restrained to allow substantially free longitudinal movement back and forth in the rolling direction, but restraining any transverse planar, yawing or rotational movement. Since the drive motors are mounted on the stands themselves, and connected to the adjoining foundations, floors, etc. only by non load-transmitting flexible hoses or cables, it becomes possible to directly measure the bar tension/compression between any two stands directly, by means of a load-bar connected between the stands.

Figure 10:
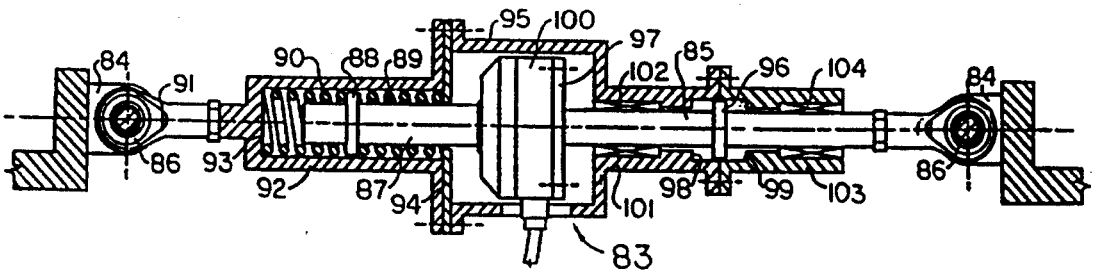
FIG. 10 is an illustrative sectional view of a load bar assembly for measuring interstand tension/compression.
Figure 11:
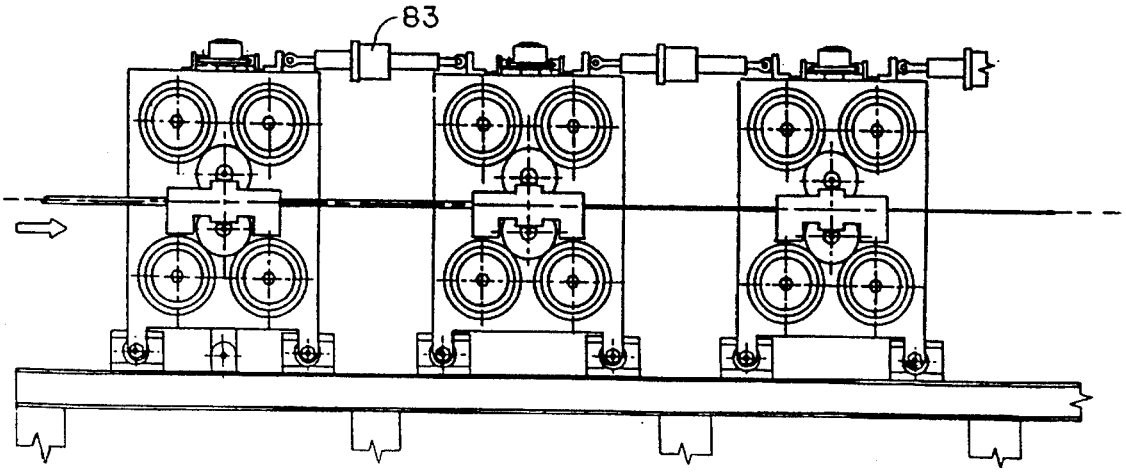
FIG. 11 is a diagrammatic view of a tandem mill train with load bars between stands adapted for direct interstand tension/compression measurement and control.

FIG. 10 illustrates a suitable load-bar assembly for directly measuring interstand tension and compression and FIG. 11 an example of load-bars sequentially applied in a tandem train of horizontal mill stands. Load-bar assembly 83 is typically mounted to connect between attachment brackets 84, each mounted on adjacent stands of a tandem train or, alternatively, in the case of one stand of a multi-stand tandem train or one individual stand, with one of the attachment brackets 84 mounted upon a fixed external member, rather than upon a stand. Assembly 83 incorporates load-cell 100 as the interstand force measuring element, of which there are numerous known variations. Rigid load cell support rod 85 carries cell mounting plate 97 at one end and universal attachment 86 to bracket 84 at the other end, thereby eliminating transverse external forces on load-bar assembly 83 due to stand alignment changes. The other load-measuring end of load-cell 100 is attached to spring-loaded cell-loading rod 87 incorporating spring two-way pusher element 88, abutting tension-force spring member (bar compression) 89 in one direction and compression-force spring member 90 (bar tension) in the other, it being appreciated that a single attached spring or other such variations could realize similar results as the two unattached coil springs 89, 90 illustrated, as confined to act against opposite end plates 93, 94 of spring-loading cylinder 92, in turn carried by spring-loaded end rod 91, universally connected to the opposing bracket 84. Load cell capsule 95, fastened to cylinder 92, incorporates an extension comprising annular alignment housings 101 and 103, carrying coaxial linear bushings 102 and 104, adapted to maintain coaxial or parallel alignment between rods 85 and 87, without significant frictional force as they move axially in relation to each other during loading. Load cells are usually limited to about 100–300 per cent overloading without damage, and overloading at bar entry or during bar cobbling may certainly be expected to exceed these values on occasion, unless very large load cells are used, greatly sacrificing precision of measurement. Spring travel and thereby maximum cell loading is therefore limited by abutment of external load ring 96 against internal shoulder stop 99 under bar compression and stop 98 under tension. Maximum cell loading is easily adjusted by substituting different spring-constant springs 89, 90.

Referring to FIG. 11, each load cell is positioned to directly measure interstand tension/compression. Since each application of load effects spring displacement, the stands must be free to move relative to each other, thus, only one stand of a successive measurement tandem train should be longitudinally fixed, most usually the first stand in the sequence, as illustrated. As an example of speed control, the electrical signal from the cell between the first and second stands may be appropriately conditioned and fed into an electro-hydraulic servo-valve, or a proportional valve, equipped with a variable zero-point setting, say, any value designated by the mill operator between 500 pounds tension and 100 pounds compression. This servo-valve could be piped so as to regulate, for example, 10 per cent of the hydraulic fluid flow driving hydraulic motors of the second stand such as by a flow control valve or swash plate of a variable displacement pump, with the balance coming from a constant volume source. This constant volume base flow would usually be adjustable to secure the correct speed range for each set-up or rolling program. Upon deviation from the zero-point setting value, the servo-valve would automatically adjust the fluid flow until the load-cell returned to the set-point value, for example, 100 pounds tension typical in later stands of a bar mill. Such circuits have many workable variations, and are well known in the art of electronics, hydraulics and the like and are deemed not to warrant detailing herein. The effect of the speed change in the second stand would also influence the interstand tension between the second and third stands, triggering another zeroing speed adjustment in the third stand, and so on down the line to the last stand in the tandem mill train.

Figure 12:
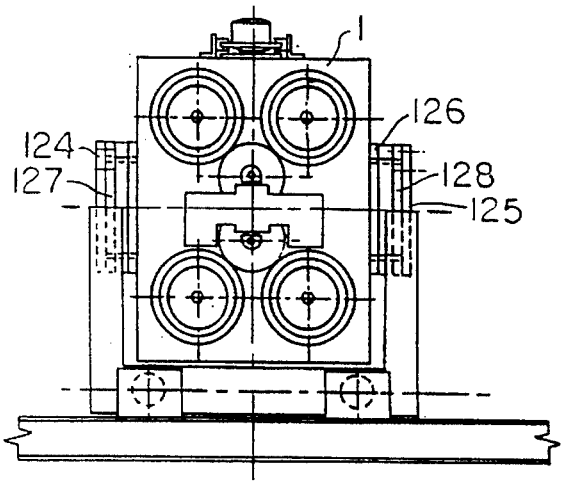
FIGS. 12 and 13 are front and side views, respectively, of a universal stand base showing a horizontal mill stand orientation.
Figure 13:
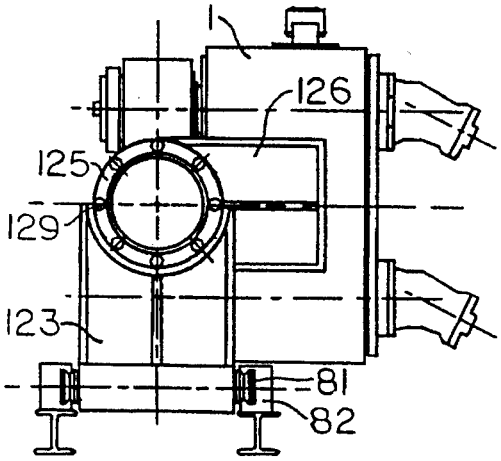
Figure 14:
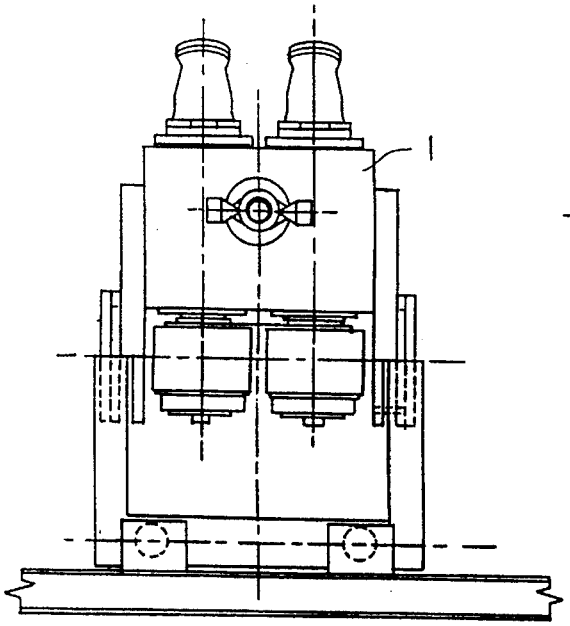
FIGS. 14 and 15 are corresponding views of the base FIGS. 12 and 13, with vertical mill stand orientation.
Figure 15:
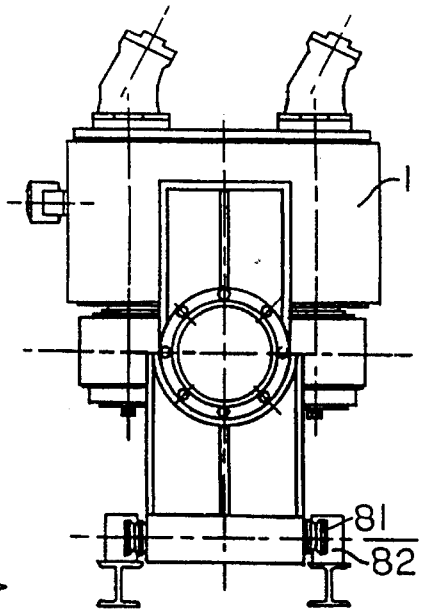
Figure 17:
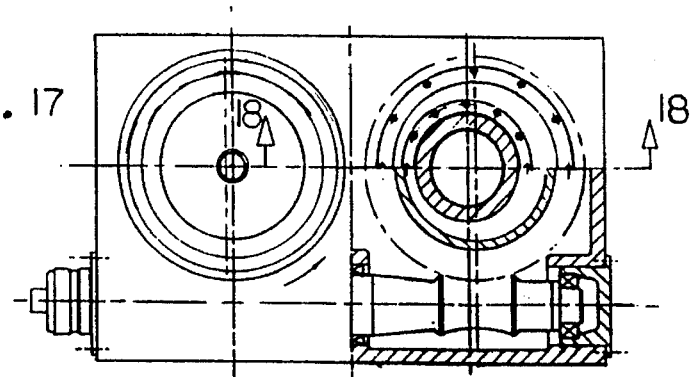
FIG. 17 is a top view of the mill stand in FIG. 16, partly in section along plane 17*a*+17*b* of FIG. 18.
Figure 16:
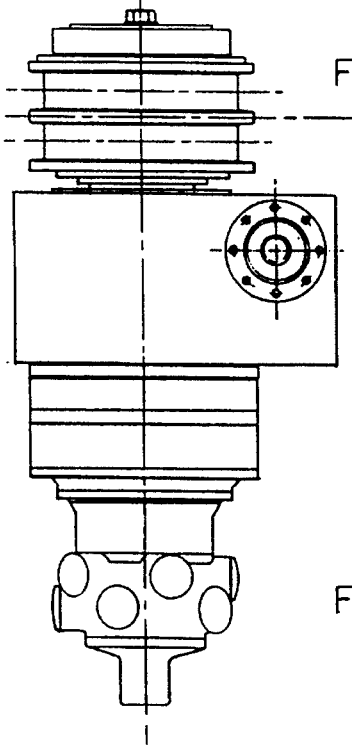
FIG. 16 is an end elevation view of a two-high mill stand incorporating invention embodiments.
Figure 18:
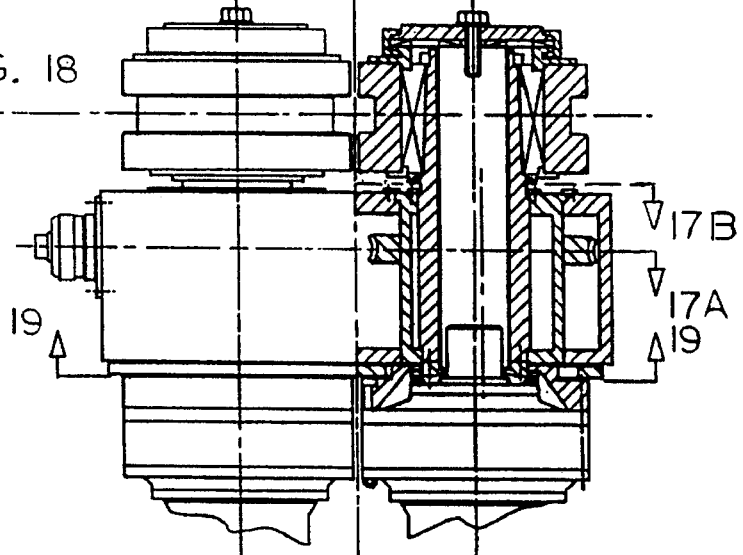
FIG. 18 is an entry (or exit) side view, partly in section, along plane 18—18 of FIG. 17.
Figure 19:
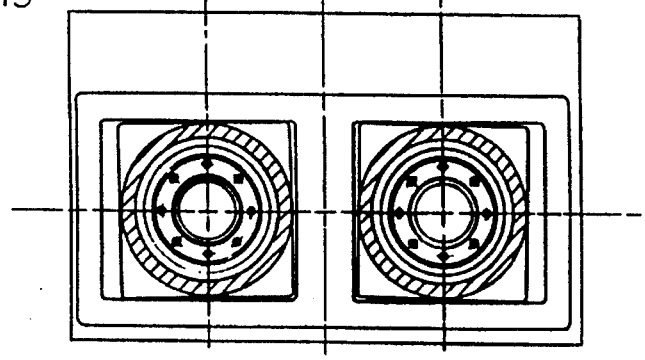
FIG. 19 is a bottom section view along plane 19—19 of FIG. 18.
Figure 20:
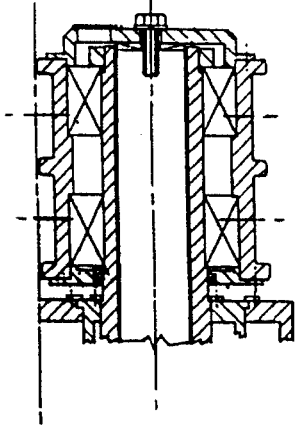
FIG. 20 is a partial sectional view through the roll ring axis, illustrating an alternative assembly for roll ring retention, support and torque transmission.

In tandem mill trains, vertical or 45 degree mounting is frequently desirable and FIGS. 12 to 15 illustrate a universal stand base enabling convenient stand changing between such stand orientations. FIGS. 12 and 13 show the stand horizontally mounted, and FIGS. 14 and 15 the same stand mounted vertically. Base bracket 123 carrying rollers 81 riding on track 82, incorporates base support flanges 124 and 125 coaxial with the rolling pass line. Housing box 1 incorporates mounting bracket 126 carrying housing box support flange 127 and 128, adapted to mate against flange 124 and 125 respectively. As shown, these flanges are bolted together and to change, for example, from horizontal to vertical, bolts 129 are simply withdrawn, the stand rotated about the pass line, re-securing bolts 129 at the new orientation.

FIGS. 16 to 20 illustrate a 2-high mill stand, incorporating direct work roll drives similar to the back-up roll drive arrangements illustrated in cluster mill FIGS. 1–6 with accompanying description. A 2-high stand suitable for low-speed roughing mill application is illustrated. Since the various parts are essentially identical to those illustrated in FIG. 6, etc., except that they are applied directly to work rolls rather than back-up rolls, reference numerals and detailed description are self-evident and are therefore omitted as redundant. It will be seen that the power units comprise a planetary gearbox and motor combination, in order to realize slow speed and high torque, as characteristic of roughing passes for larger stock sections. Clamshell housings, universal mountings and tandem load-bar linkages may also be applied to such 2-high stands.

It will be appreciated that a preferred embodiment of an improved rolling mill stand has been described and illustrated and that variations and modifications may be made by persons skilled in the art, without departing from the scope of the invention defined in the appended claims.

I claim:

1. A rolling mill stand having a housing with rolls cantilevered out from a front wall of the housing, with at least one top roll assembly and one bottom roll assembly, each comprising in combination:

a cantilevered roll shaft sleeve arbor projecting out from said from wall, incorporating an axis and an open-ended axial passage extending through a back wall of said housing;

a roll ring mounted externally concentric to said arbor;

annular bearing means interfacing between said arbor and said roll ring, radially fixing and supporting, but allowing rotation of said roll ring about said arbor;

roll drive-shaft means within said axial passage and coaxial with said arbor, including drive means adapted for rotation of said drive-shaft means and to provide torque as required for rolling;

radial coupling means connecting between said drive-shaft means and said roll ring adapted for transmitting said torque and rotation from said roll drive-shaft means to said roll ring.

2. A rolling mill stand according to claim 1 also including roll parting adjustment means adapted for adjusting a distance of separation between said arbors and thereby between said top roll assembly and said bottom roll assembly.

3. A cantilevered cluster rolling mill stand having a housing with at least two top and bottom back-up rolls cantilevered out from a front wall of the housing, with drive means of at least one top back-up roll assembly rotating a top work roll by frictional surface contact and drive means of at least one bottom back-up roll assembly rotating a bottom work roll, wherein a removable work roll cartridge sub-assembly is integral with said top and bottom work rolls, said cartridge sub-assembly comprising:

a rigid support frame;

work roll-end chock means;

axial-positioning bearing means carried by said chock means confining each end of each of said work rolls, adapted for maintaining a substantially fixed axial position of said top and bottom work rolls in relation to each other.

4. A rolling mill stand according to claim 3 which also includes axial adjustment means for said axial-positioning bearing means, adapted for adjusting said fixed axial position.

5. A rolling mill stand according to claim 3 wherein at least one top and one bottom said back-up rolls is carried by a roll assembly comprising:

a cantilevered back-up roll shaft sleeve arbor projecting out from the housing front wall incorporating an axis and an open-ended axial passage extending through a back wall of said housing;

a back-up roll ring mounted externally concentric to said arbor;

annular bearing means interfacing between said arbor and said back-up roll ring, radially fixing and supporting, but allowing rotation of said roll ring about said arbor;

back-up roll drive shaft means within said axial passage and coaxial with said arbor, including drive means adapted for rotation of said drive-shaft means and to provide torque as required for rolling; and radial coupling means connecting between said drive-shaft means and said back-up roll ring, adapted for transmitting said torque and rotation from said drive-shaft means to said back-up roll ring.

6. A rolling mill stand according to claim 3, claim 4 or claim 5, which includes roll balancing means integral to said work roll cartridge sub-assembly pressing apart and separating said chock means, adapted to maintain each said top and bottom work roll in contact with the back-up rolls when the mill stand is empty as well as during bar passage.

7. A rolling mill stand according to claim 3, or claim 4, or claim 5 which includes roll balancing means integral to said work roll cartridge sub-assembly pressing apart and separating said chock means, adapted to maintain each said top and bottom work roll in contact with the backup rolls when the mill is empty as well as during bar passage;

rolling guide means mounted upon said rigid support frame adapted to guide a bar being rolled along a substantially fixed pass line in relation to said support frame;

symmetrical work roll separator means incorporated with said roll balancing means adapted for supporting and separating said top and bottom work roll chock means each to move only equal distances together and apart about said fixed pass line thereby maintaining substantially the same alignment of said guides with said pass line across various settings of a parting between said top and bottom work rolls.

8. A rolling mill stand according to claim 3, claim 4, or claim 5 also including, in combination:

work roll cartridge sub-assembly stop means mounted on said housing;

side-bracket lug means mounted on said cartridge sub-assembly, adapted to abut said cartridge sub-assembly stop means upon work roll insertion between the back-up rolls and thereby axially align said work rolls with said back-up rolls during rolling; and latch retainer means adapted to latch and hold said lug means against said stop means during operation, thereby maintaining said work roll cartridge sub-assembly axially fixed in position, and to retract and allow cartridge sub-assembly removal and replacement during non-operating periods.

9. A rolling mill stand according to claim 1, claim 2 or claim 5 wherein each of said roll assemblies also include:

circular screwdown sleeve means encircling said roll shaft sleeve arbor with an axis parallel but with an eccentric offset from the axis of said arbor, said screwdown sleeve means incorporating circular peripheral surfaces adapted for sliding rotation within annular load-bearing surfaces of apertures of said housing, proximate said front wall and said back wall;

screwdown rotation and angular positioning means for said circular screwdown sleeve means, adapted to adjust a roll parting distance between said top roll and bottom roll assembly, as effected by change of an angle between said eccentric offset and a plane containing the axis of the said arbor and perpendicular to a plane containing the axes of both top and bottom roll arbors.

10. A rolling mill stand according to claim 1, claim 2 or claim 5 wherein each of said roll assemblies also include:

circular screwdown sleeve means encircling said roll shaft sleeve arbor with an axis parallel but with an eccentric offset from the axis of said arbor, said screwdown sleeve means incorporating circular peripheral surfaces adapted for sliding rotation within annular load-bearing surfaces of apertures of said housing, proximate said front wall and said back wall;

screwdown rotation and angular positioning means for said circular screwdown sleeve means, adapted to adjust a roll parting distance between said top roll and bottom roll assembly, as effected by change of an angle between said eccentric offset and a plane containing the axis of the said arbor and perpendicular to a plane containing the axes of both top and bottom roll arbors, and wherein said screwdown rotation and angular positioning means comprises:

worm gear means concentrically encircling each said sleeve arbor with said worm gear means mounted upon top roll sleeve means vertically and symmetrically aligned above corresponding worm gear means mounted upon bottom roll sleeve means;

a vertically oriented worm shaft means carrying a top worm screw means located between and meshing with two top worm gear means and also a bottom worm screw means of opposite hand between and meshing with said bottom worm gear means;

worm shaft rotation means adapted to rotate said sleeve means and thereby adjust a parting of said top and bottom rolls symmetrically above and below a rolling pass line.

11. A rolling mill stand according to claim 1, claim 2, claim 3, claim 4 or claim 5 wherein said roll drive means comprises an individual top roll drive motor assembly rigidly coupled to a top roll drive-shaft means and an individual bottom roll drive motor assembly rigidly coupled to a bottom roll drive-shaft means of opposite rotational direction;

at least one pair of radially projecting torque-arm-couple lug means mounted on each said drive motor assembly, each lug being radially fixed and projecting out from said top and bottom drive motor assembly on opposite sides of the axis of rotation of each said drive-shaft means;

a floating torque-reaction frame means encompassing both said top and bottom roll drive motor assemblies;

at least one pair of essentially parallel inner lug-stop surfaces integral to said frame means, one surface of said pair located on either side of a plane containing said top roll and bottom roll drive-shaft axes, said surfaces thereby being adapted to intercept and maintain contact with said lug means restraining said drive motor assemblies from rotation, at the same time holding said frame in a position with respect to the drive-shaft axes which equalizes the opposing forces between said lugs on opposite sides said drive shaft, thereby substantially eliminating any significant resultant side force upon said drive shaft and motor assembly as drive torque are applied via said lugs, in combination with offsetting the drive torque couple on the top roll drive-shaft by a substantially equal torque couple on the bottom roll drive-shaft of the opposite rotational direction;

roll parting adjustment means adapted for adjusting the parting between said top and bottom roll drive-shafts, and thereby also the parting between the work rolls, wherein there is a minimum dimensional clearance available between said roll drive motor assembly with attached lug means and said lug-stop surfaces, adapted to allow adjustment of the distance of separation between said top and bottom roll drive motor assemblies by movement within said frame and thereby adjustment of the distance of work roll parting.

12. A rolling mill stand according to claim 1, claim 2, claim 3, claim 4 or claim 5 wherein said drive means comprise motors supported substantially only by said roll assemblies which, in turn, are supported only by said housing and thereby an external support for said housing essentially supports indirectly only the weight of the drive means, adapted to confine drive-torque reaction forces within said housing and roll assemblies rather than against the housing external support or any drive mounting or other supporting or adjacent structures.

13. A rolling mill stand according to claim 1, claim 2, claim 3, claim 4 or claim 5, which is mounted for rolling common interstand stock, in tandem with at least a preceding mill stand, wherein said drive means comprise motors supported substantially only by said roll assemblies which, in turn, are supported only by said housing and thereby an external support for said housing essentially supports indirectly only the weight of the drive means, adapted to confine drive-torque reaction forces within said housing and roll assemblies rather than against the housing external support or any drive mounting or other supporting or adjacent structures, and wherein said external support for said housing comprises:

linear bearing support means for said rolling mill stand adapted to allow substantially free longitudinal stand movement back and forth in a rolling direction, but substantially preventing transverse planar, yawing or rotational movement;

load-bar means connecting between said rolling mill stand and an immediately preceding tandem mill stand, adapted to directly measure longitudinal tension/compression force within said interstand stock;

and speed regulation means adapted for adjusting roll rotational speed said rolling mill stand to substantially maintain said tension/compression force at a preselected magnitude during rolling.

14. A rolling mill stand according to claim 1, claim 2, claim 3, claim 4 or claim 5, which is mounted for rolling common interstand stock, in tandem with at least a preceding mill stand, wherein said drive means comprise motors supported substantially only by said roll assemblies which, in turn, are supported only by said housing and thereby an external support for said housing essentially supports indirectly only the weight of the drive means, adapted to confine drive-torque reaction forces within said housing and roll assemblies rather than against the housing external support or any drive mounting or other supporting or adjacent structures, and wherein said external support for said housing comprises:

linear bearing support means for said rolling mill stand adapted to allow substantially free longitudinal stand movement back and forth in a rolling direction, but substantially preventing transverse planar, yawing or rotational movement;

load-bar means connecting between said rolling mill stand and an immediately preceding tandem mill stand, adapted to directly measure longitudinal tension/compression force within said interstand stock;

and speed regulation means adapted for adjusting roll rotational speed of said rolling mill stand to substantially maintain said tension/compression force at a preselected magnitude during rolling; and wherein said load-bar incorporates a load-measuring cell to which interstand tension or compression is applied via intermediate springs, and in which a maximum travel of said springs is limited by mechanical stops, thereby limiting a maximum pressure applied to the load-measuring cell to a value of spring tension or compression force at contact with said stops, a balance of the interstand forces being borne by rigid members integral with said load-bar means.

* * * * *